US010690009B2

(12) United States Patent
Takata

(10) Patent No.: US 10,690,009 B2
(45) Date of Patent: Jun. 23, 2020

(54) WATER REMOVAL DEVICE FOR STEAM TURBINE AND METHOD FOR FORMING SLIT

(71) Applicant: MITSUBISHI HITACHI POWER SYSTEMS, LTD., Kanagawa (JP)

(72) Inventor: Ryo Takata, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 908 days.

(21) Appl. No.: 14/903,782

(22) PCT Filed: May 12, 2014

(86) PCT No.: PCT/JP2014/062569

§ 371 (c)(1),
(2) Date: Jan. 8, 2016

(87) PCT Pub. No.: WO2015/015859

PCT Pub. Date: Feb. 5, 2015

(65) Prior Publication Data

US 2016/0169051 A1 Jun. 16, 2016

(30) Foreign Application Priority Data

Jul. 30, 2013 (JP) ..... 2013-158313

(51) Int. Cl.
*F01D 25/32* (2006.01)
*F01D 9/04* (2006.01)

(52) U.S. Cl.
CPC ..... *F01D 25/32* (2013.01); *F01D 9/041* (2013.01); *F05D 2220/31* (2013.01);
(Continued)

(58) Field of Classification Search
CPC ..... F01D 25/32; F01D 5/186; F05D 2250/13
See application file for complete search history.

(56) References Cited

U.S. PATENT DOCUMENTS 6,474,942 B2 11/2002 Markytan
8,157,526 B2 * 4/2012 Beck ..... F01D 5/186 416/97 R (Continued)

FOREIGN PATENT DOCUMENTS

CN 101769175 7/2010
JP 49-9522 3/1974

(Continued)

OTHER PUBLICATIONS

Decision to grant a patent issued Jul. 29, 2016 in corresponding Japanese Application No. 2015-529412 (with English translation).

(Continued)

*Primary Examiner* — Woody A Lee, Jr.
*Assistant Examiner* — Michael L Sehn
(74) *Attorney, Agent, or Firm* — Wenderoth, Lind & Ponack, L.L.P.

(57) ABSTRACT

A hollow portion is defined inside a stator blade, and a slit, extending in a height direction of the stator blade, opens to a surface of the stator blade and is in communication with the hollow portion. The slit is defined on the surface of the stator blade and includes a recess portion which is flat and has a longitudinal side extending in the height direction of the stator blade, and at least one through hole which opens to a bottom surface of the recess portion and to the hollow portion. In a projection plane to which a cross section of the slit is projected in the height direction of the stator blade, an area of an inlet opening of the through hole which opens to the bottom surface of the recess portion occupies a part of a projection width of the recess portion.

7 Claims, 11 Drawing Sheets

(52) U.S. Cl.
CPC ..... *F05D 2230/10* (2013.01); *F05D 2230/12* (2013.01); *F05D 2240/123* (2013.01); *F05D 2250/182* (2013.01); *F05D 2250/294* (2013.01); *F05D 2250/312* (2013.01); *F05D 2260/602* (2013.01)

(56) References Cited

U.S. PATENT DOCUMENTS

| | | | | |
|---|---|---|---|---|
| 2006/0073015 | A1* | 4/2006 | Liang | F01D 5/186 416/97 R |
| 2011/0135447 | A1* | 6/2011 | Guo | F01D 5/147 415/115 |
| 2011/0189015 | A1* | 8/2011 | Shepherd | F01D 5/186 416/95 |
| 2012/0148769 | A1* | 6/2012 | Bunker | B23P 15/04 428/34.1 |
| 2013/0001203 | A1* | 1/2013 | Mironets | B23H 1/02 219/69.13 |

FOREIGN PATENT DOCUMENTS

| | | | | |
|---|---|---|---|---|
| JP | 63-117104 | | 5/1988 | |
| JP | 64-80705 | | 3/1989 | |
| JP | 3-47403 | | 2/1991 | |
| JP | H04140401 | A * | 5/1992 | F01D 9/02 |
| JP | 9-25803 | | 1/1997 | |
| JP | 11-210404 | | 8/1999 | |
| JP | 2011-117451 | | 6/2011 | |

OTHER PUBLICATIONS

First Office Action dated May 25, 2016 in related Chinese Application No. 201480034085.3 (with English translation).

Extended European Search Report dated Jul. 6, 2016 in corresponding European Application No. 14832113.6.

Extended European Search Report dated Jun. 24, 2016 in corresponding European Application No. 14832891.7.

International Search Report dated Jun. 10, 2014 in corresponding International Application No. PCT/JP2014/062569.

International Preliminary Report on Patentability dated Feb. 2, 2016 in corresponding International Application No. PCT/JP2014/062569.

Examination Report dated Mar. 19, 2019 in Indian Patent Application No. 201627000538.

* cited by examiner

ENLARGED VIEW OF PORTION X

Y-Y CROSS SECTION

ENLARGED VIEW OF PORTION Y

WATER REMOVAL DEVICE FOR STEAM TURBINE AND METHOD FOR FORMING SLIT

TECHNICAL FIELD

The present disclosure relates to a water removal device which is capable of removing water contained in wet steam flow in a steam turbine and a method for forming a slit on a surface of a stator blade for introducing water on the surface of the stator blade.

BACKGROUND

Steam flow in a steam turbine has a wetness of at least 8% near the last stage turbine. The steam flow generates water drops, and the wet steam flow may lead to a moisture loss, and the turbine efficiency may be reduced. In addition, the water drops generated from the wet steam flow may collide with a rotor blade rotating at a high speed, which may lead to erosion. The water drops contained in the wet steam flow attach on a surface of a stator blade to from a water film. The water film is forced by the wet steam flow to form a water film flow, and the water film flow flows to the trailing edge side of the stator blade. Then, the water film flow may break at the trailing edge of the stator blade and form coarse water drops on a downstream side of the stator blade. The coarse water drops may be one of the greatest reasons that cause erosion of the rotor blade.

FIG. 16 is a diagram illustrating a flow field of a steam flow of a steam turbine. A stator blade 100 is disposed between and connected to a diaphragm 104 provided on a rotor shaft (not shown) side and a support ring 106 provided on a tip side. Small water drops dw contained in a wet steam flow s attach onto a surface of the stator blade 100, particularly onto a pressure surface fs of the stator blade, which faces to more amount of wet steam flow s than a suction surface bs of the stator blade, and the water drops collect on a surface of the stator blade to form a water film flow sw moving toward the trailing edge side of the stator blade. The water film flow sw on the surface of the stator blade flows from the leading edge fe side of the stator blade to the trailing edge re side of the stator blade, and it breaks into coarse water drops cw at the trailing edge re of the stator blade. The coarse water drops cw collide with a rotor blade on a downstream side to erode a surface of the rotor blade.

FIG. 17 is a diagram illustrating a velocity triangle of a wet steam flow s at the outlet of the stator blade. An absolute velocity Vcw of a coarse water drop cw is smaller than an absolute velocity Vs of the wet steam flow s on the outlet portion of the stator blade. Accordingly, in the relative velocity field considering the circumferential velocity U of the rotor blade 102, the coarse water drop cw has a relative velocity Wcw which is larger than the relative velocity Ws of the wet steam flow s and has a smaller incident angle, and it collides with a surface of the rotor blade 102 at a high speed. Thus, the rotor blade 102 is susceptible to erosion by the coarse water drops cw, particularly near the tip of the blade where the circumferential velocity is relatively large. Further, the collision of the coarse water drops cw may lead to increase in breaking loss of the rotor blade 102.

In view of this, in order to remove water drops on a surface of a rotor blade, such a method is conventionally employed that a slit opening to a surface of a stator blade is formed to introduce the water drops on the surface of the stator blade from the slit, thereby to remove the water drops from the flow field of the steam flow. Each of JP H64-080705 A and JP H09-025803 A discloses a structure of a stator blade having such a slit formed.

FIG. 18 to FIG. 21 are diagrams of an example of a stator blade having such a slit formed. In FIG. 18, the both ends in the axial direction of the stator blade 100 are connected to a diaphragm 104 which has a separated body from a rotor shaft 108 and which is provided on the rotor shaft 108 side, and a support ring 106 on a tip side, respectively. The rotor blade 102 is integrally formed with the rotor shaft 108 via a disk rotor 110. Plurality of slits 112 and plurality of slits 114, extending along the axial direction of the stator blade 100, are formed on the pressure surface fs and the suction surface bs of the stator blade, respectively. Inside the support ring 106, a hollow portion 106*a* is formed.

As shown in FIG. 19 and FIG. 20, a hollow portion 100*a* is formed inside the stator blade 100. The hollow portion 100*a* is in communication with the hollow portion 106*a* via a hole 106*b* formed in the support ring 106. The hollow portion 100*a* is in communication with a low pressure region via a hole 106*c*. The water film flow sw on the surface of the stator blade and flowing toward the trailing edge is drawn through the slits 112 and 114 into the hollow portion 100*a*. A slit groove 116 is formed at a back end of the support ring 106, and the slit groove 116 is in communication with the low pressure region. The low pressure region has a relatively low pressure than the flow field of the steam flow such that the water film flow sw can be drawn through the slits 112 and slits 114 and discharged to the hollow portion 106*a*.

FIG. 20 is a diagram illustrating a conventional example having a slit 112 opening to the pressure surface of the stator blade. The water film flow sw formed on the pressure surface fs of the stator blade collects water drops and the collection amount of the water drops becomes larger as the water film flow moves from the leading edge fe of the stator blade to the trailing edge re of the stator blade. Thus, in order to increase the water removal amount, the slits opening to the pressure surface fs of the stator blade are formed at the most trailing edge side of the stator blade in such a range that communication between the slits 112 and the hollow portion 100*a* is possible.

Further, as shown in FIG. 21, the stator blade trailing edge side wall surface 112*a* and the stator blade leading edge side wall surface 112*b* of the slit 112, which is formed on the pressure surface fs of the stator blade according to the conventional technique, are formed so as to have an inclination angle A of larger than 90°, to the leading edge side reference plane of the pressure surface fs of the stator blade, as disclosed in JP H64-080705 A. This is because, by making the widths of the inlet opening e and the outlet opening f of the slit 112 larger than the slit width h of the slit 112, and by permitting the slit 112 to face the flow direction of the wet steam flow s, the wet steam flow s becomes likely to move into the slit. Thus, the wet steam flow s may be actively drawn into the slit 112, and the water film flow sw may be drawn along with the wet steam flow s into the slit 112.

Technical Problem

With the conventional slit 112 as shown in FIG. 21, there may be a problem such that it may introduce a large amount of steam along with water, and accordingly, the leakage loss of the steam may increase, and the turbine efficiency may be reduced.

SUMMARY

The present invention has been made in view of such problem, and at least one embodiment of the present invention is to improve removal efficiency of a water film flow formed on a surface of a stator blade and suppress leakage loss of the steam flow by means of a simple processing of the stator blade, thereby to reduce the turbine efficiency.

Solution to Problem

In order to solve the above problem, the water removal device for a steam turbine according to at least an embodiment of the present invention comprises: a water removal flow passage formed inside a stator blade; and a slit extending in a direction intersecting with a steam flow and opening to the surface of the stator blade and being in connection with the water removal flow passage. The slit includes a recess portion having a difference in level from the surface of the stator blade, and at least one through hole which opens to a bottom surface of the recess portion and to the water removal flow passage. In a projection plane to which a cross section of the slit is projected in a height direction of the stator blade, an area of an inlet opening of the through hole which opens to the bottom surface of the recess portion occupies a part of a projection width of the bottom surface of the recess portion.

With the above configuration, since the recess portion is formed to provide a relatively wide inlet opening (water introducing area) of the slit, it is possible to improve the water removal efficiency. On the other hand, since the cross section area of the through hole which is communicated with the water removal flow passage is relatively small, it is possible to remove water while suppressing leakage of the steam flow, which is valuable as energy.

Further, since in the projection plane to which a cross section of the slit is projected in the height direction of the stator blade, the area of an inlet opening of the through hole which opens to the bottom surface of the recess portion occupies a part of a projection width of the bottom surface of the recess portion, a bottom surface of the recess portion, which has a difference in level from the surface of the stator blade may be formed around the through hole. By introducing a water film flow from the surface of the stator blade to the bottom surface of the recess portion, and then permitting the water film flow to flow into the through hole, it is possible to more effectively separate water from the steam flow.

The through hole may have various shapes. The axial direction of the through hole may be suitably selected depending on the design conditions, and it may be perpendicular to the bottom surface of the recess portion, or it may be inclined to the bottom surface of the recess portion. The through hole may have a cross section having a circular or polygonal shape, or the through hole may be formed into a slit-like shape. For example, if the inlet opening side region has a cross section of an inverted trapezoid like shape, water becomes more likely to be introduced.

In some embodiments, the through hole of the slit is formed in a tip side region of the surface of the stator blade.

In the flow field of the steam flow, the pressure is higher in the hub side region than in the tip side region, of the stator blade. Thus, if the slit is formed over the entire region in the height direction of the stator blade, a circulation flow may be generated, where steam flow flowing from the through hole formed in the hub side region into the water removal flow passage may reversely flows from the through hole formed in the tip side region to the steam flow field, and the water removal efficiency may be reduced. With the above configuration, since the through hole is formed in the tip side region, it is possible to suppress the above circulation flow.

In some embodiments, the slit is formed so as to open to the surface of the stator blade. The through hole has an inlet opening which opens to the surface side corresponding to a trailing edge side end portion of the water removal flow passage, and the slit has an outlet opening which is in communication with a trailing edge side end portion of the slit.

Since the water film flow formed on the surface of the stator blade flows toward the trailing edge of the stator blade with the steam flow, the water amount increases as the water film flow flows closer to the trailing edge. In particular, as described above, the water film flow formed on the pressure surface of the stator blade collects water drops to increase the collection amount as it flows from the leading edge of the stator blade to the trailing edge. Accordingly, by forming the slit opening to the pressure surface of the stator blade as closer to the trailing edge side of the stator blade as possible within a range where communication with the water removal flow passage, it is possible to increase the water removal amount. Therefore, it is possible to increase the water removal amount particularly when the slit opening to the pressure surface of the stator blade is provided.

In some embodiments, in addition to the above configuration, an axial direction of the slit is at an acute angle to a leading edge side reference plane of the surface of the stator blade.

In this specification, the wording "a leading edge side reference plane of the pressure surface of the stator blade" is used when it is intended to specify an inclination angle of a wall surface constituting the slit to the pressure surface of the stator blade where a part of the pressure surface of the stator blade which part is closer to the leading edge of the stator blade than the wall surface is the reference plane.

With the above configuration, the outlet opening of the through hole being in communicated with the water removal flow passage may be disposed on the leading edge side of the stator blade, and accordingly the inlet opening of the slit may be disposed on the trailing edge side of the stator blade where the total water collection rate is large. It is thereby possible to increase the water removal amount through the slit.

In some embodiments, the through hole has an inlet opening formed in a stator blade trailing edge side end portion of the bottom surface of the recess portion. That is, it may be that in a projection plane to which a cross section of the slit is projected in a width direction of the stator blade, an area of an inlet opening of the through hole which opens to the bottom surface of the recess portion occupies a part of a projection width of the recess portion, and the inlet opening of the through hole opens to the stator blade trailing edge side end portion of the bottom surface of the recess portion. It is thereby possible to introduce the water film flow from the surface of the stator blade to the recess portion and store the water film flow on the bottom surface of the recess portion, thereby to more effectively separate the water film flow from the steam flow.

In some embodiments, an axial direction of the through hole is inclined from an inlet opening to an outlet opening toward a tip of the stator blade.

On the surface of the stator blade, the steam flow flows in various directions. For example the steam flow may flow from the hub side to the tip side of the stator blade. With such flow, the water film flow on the surface of the stator blade may flow in the same direction. With the above configuration, since the axial direction of the through hole is inclined from an inlet opening to an outlet opening toward a tip of the stator blade, it is possible increase the amount of water introduced to the through hole.

A method for forming the above-described slit according to at least an embodiment of the present invention comprises: a recess portion forming step of forming, on the surface of the stator blade, a recess portion having a difference in level from the surface of the stator blade by means of electric discharge machining; and a through hole forming step of forming at least one through hole by cutting work so that: the through hole opens to a bottom surface of the recess portion and to the water removal flow passage; and in a projection plane to which a cross section of the slit is projected in the height direction of the stator blade, an area of an inlet opening of the through hole which opens to the bottom surface of the recess portion occupies a part of a projection width of the bottom surface of the recess portion.

For forming a stator blade, a Ni-based alloy, known as a hard-to-cut material, which has good strength at high temperature and corrosion resistance is used. Thus, high-precision processing of such a Ni-based alloy including forming a slit is usually carried out by means of electric discharge machining, which is expensive.

In the method according to the above embodiment, because the through hole may be formed by cutting work using a drill, the slit may be formed at a low cost. Further, by using drill having a small diameter, a through hole having a small diameter may be formed. Therefore, it is possible to effectively suppress leakage of the steam flow.

Advantageous Effects

According to at least an embodiment of the present invention, since the slit includes a recess portion having a bottom and a through hole opening to the bottom surface of the recess portion and the water removal flow passage and having a relatively small cross section, it is possible to improve water removal efficiency and suppress leakage of the steam flow, which is valuable as energy, by simple processing of the stator blade, whereby it is possible to suppress reduction in turbine efficiency.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

First Embodiment

Figure 1:
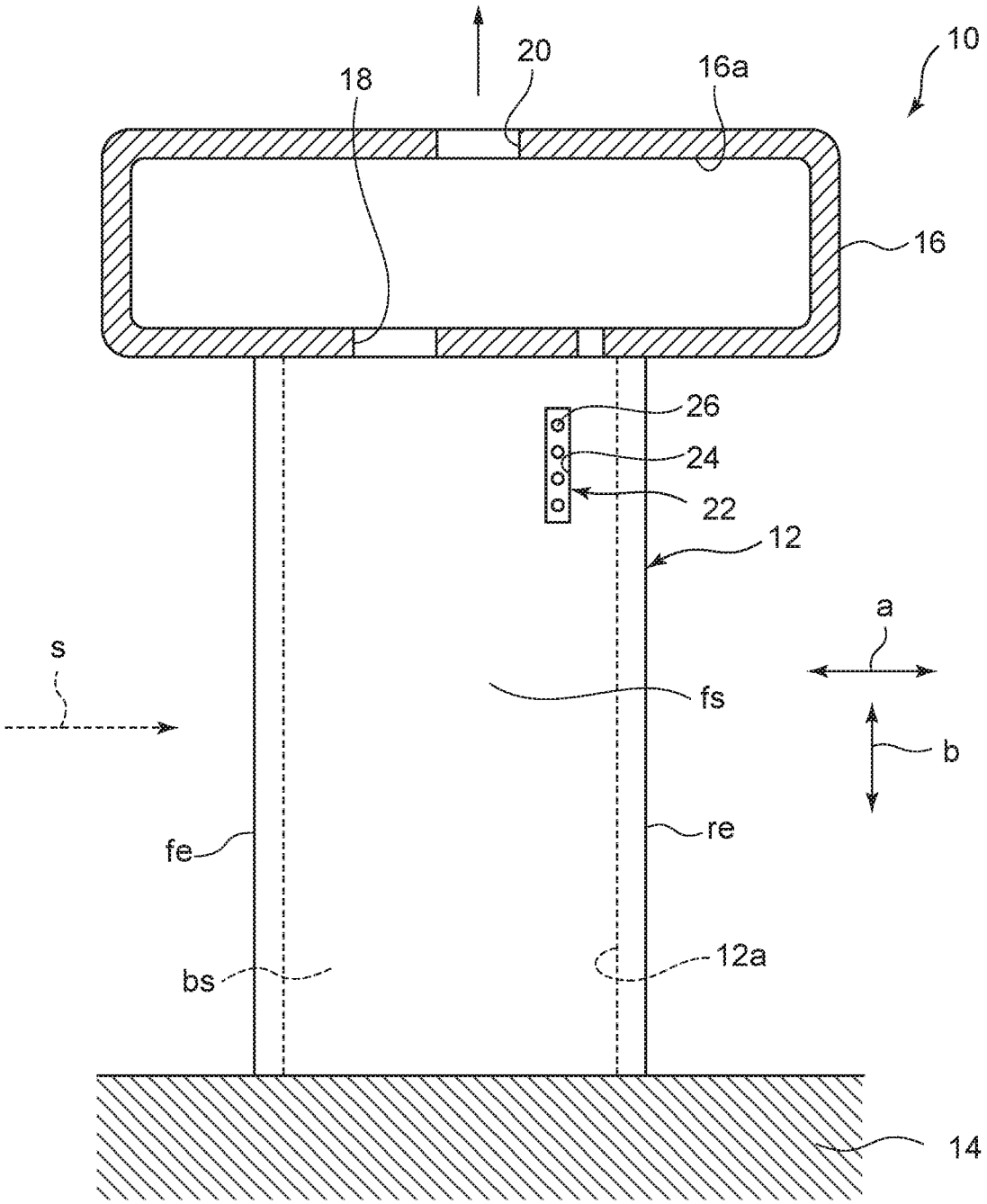
FIG. 1 is a front view of a water removal device according to a first embodiment of the present invention.
Figure 17:
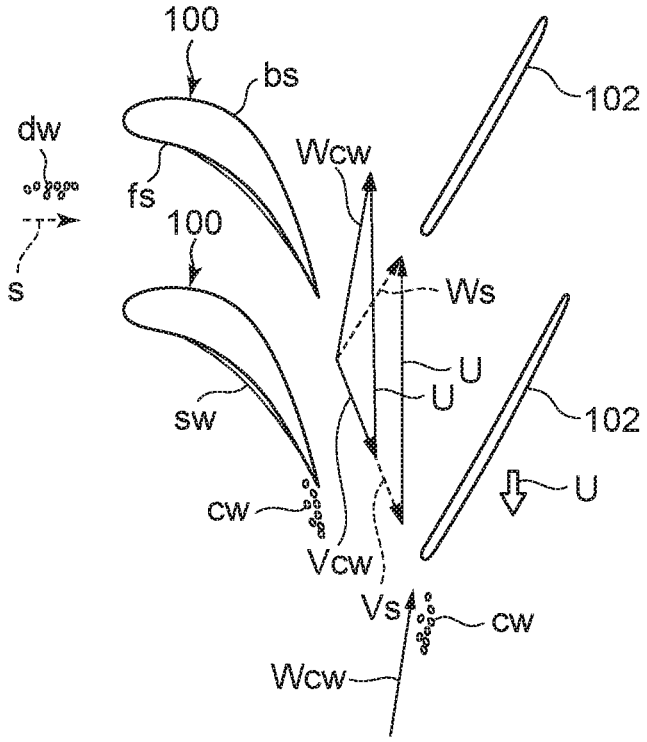
FIG. 17 is a chart showing a velocity triangle of a wet steam flow on a downstream side of the stator blade.
Figure 18:
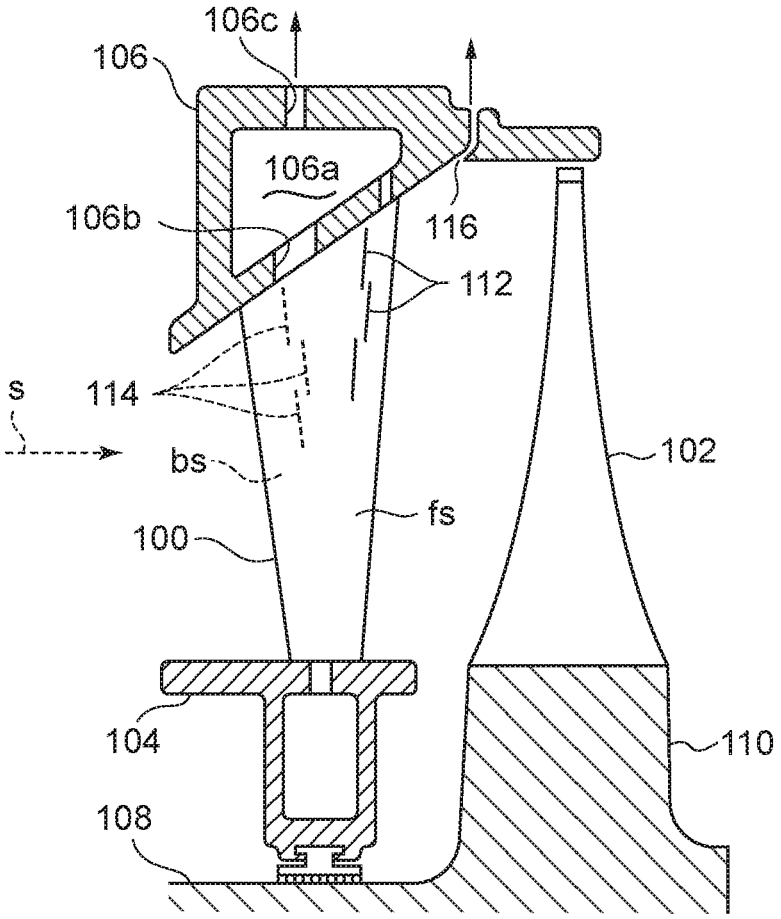
FIG. 18 is a cross sectional view of a conventional water removal device.
Figure 19:
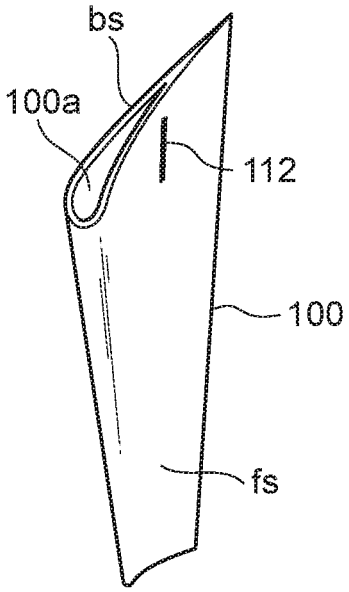
FIG. 19 is a perspective view of a conventional stator blade having a slit.
Figure 20:
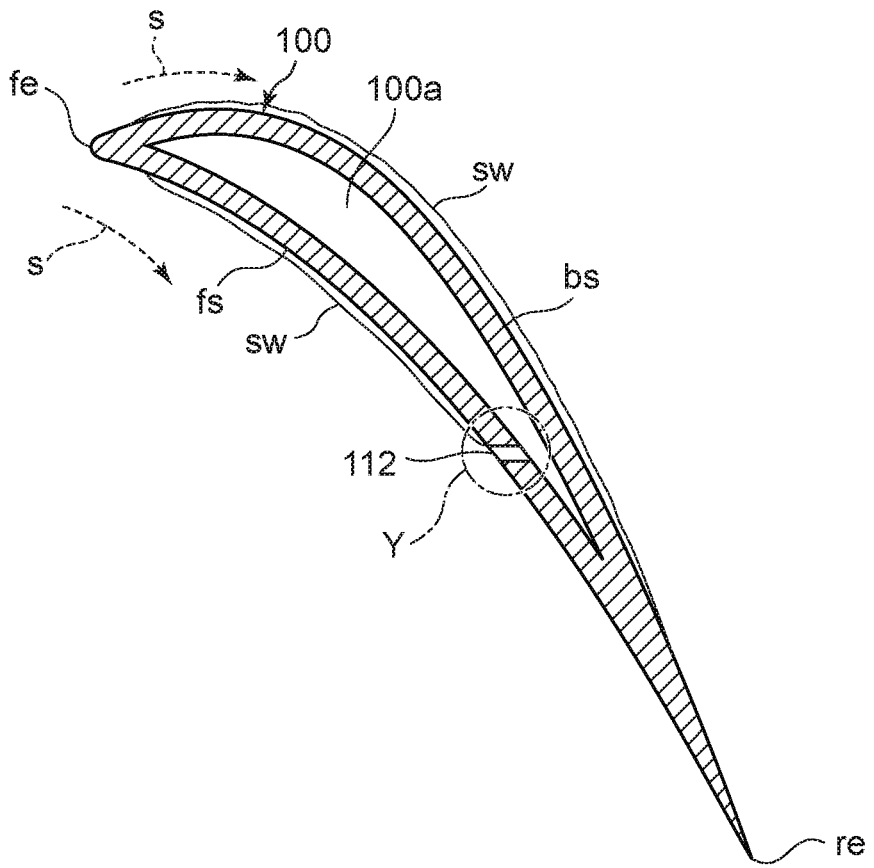
FIG. 20 is a cross sectional view of a conventional stator blade having a slit.

Now, a water removal device according to a first embodiment of the present invention will be described with reference to FIG. 1 to FIG. 5. In FIG. 1, a stator blade 12 is provided in a flow path of a wet steam flow of a steam turbine. The hub portion of the stator blade 12 is connected to a diaphragm 14, and the tip portion of the stator blade 12 is connected to a support ring 16. The surface of the stator blade 12 is disposed in the same direction to the wet steam flow s as in the stator blade 100 illustrated in FIG. 17.

Figure 2:
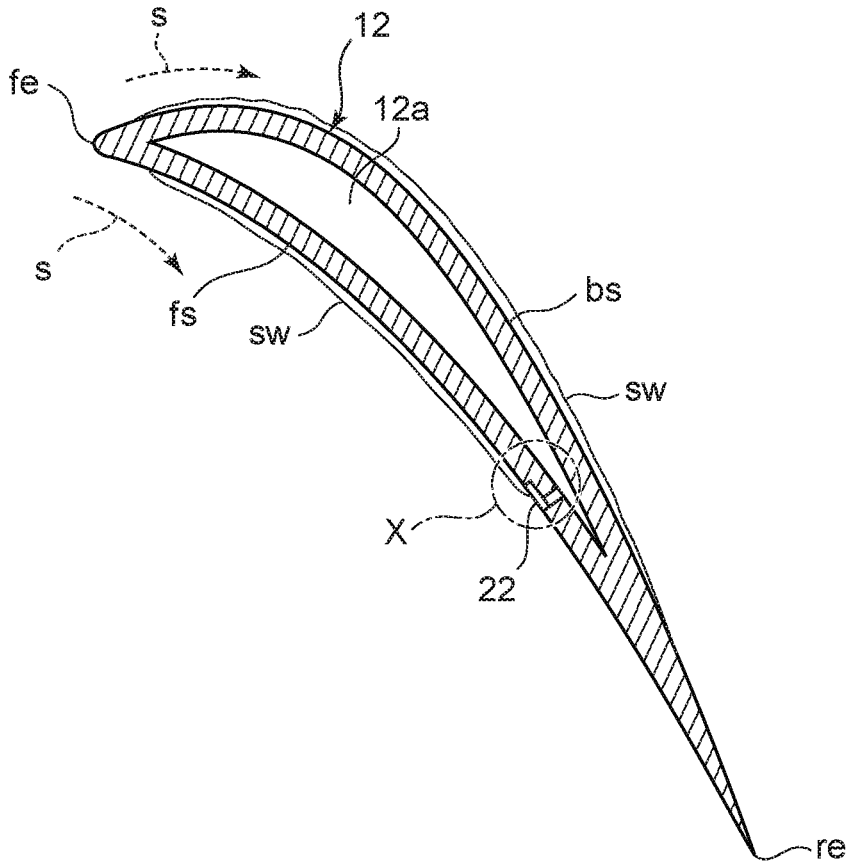
FIG. 2 is a transverse sectional view of a stator blade according to the first embodiment.

That is, as illustrated in FIG. 2, the leading edge fe of the stator blade is disposed on an upstream side and the trailing edge re of the stator blade is disposed on a downstream side of the wet steam flow s, and the pressure surface fs of the stator blade is disposed so as to face the wet steam flow s and so as to be inclined to the wet steam flow s. Water such as water drops contained in the wet steam flow s forms water drops on the pressure surface fs of the stator blade and the suction surface bs of the stator blade. In FIG. 1, the arrow a indicates the width direction of the stator blade 12, and the arrow b indicates the height direction of the stator blade 12.

In the water removal device 10, a hollow portion 12*a* is formed inside the stator blade 12, and a hollow portion 16*a* is formed inside the support ring 16. The hollow portion 12*a* and the hollow portion 16*a* are communicated with each other via a hole formed in the support ring 16. The hollow portion 16*a* has a hole 20 communicated with a region having a lower pressure than the flow field of the wet steam flow s, and each of the hollow portion 12*a* and the hollow portion 16*a* has a lower pressure than the flow field of the wet steam flow s.

As illustrated in FIG. 2, the wet steam flow s flows from the leading edge fe side of the stator blade along the pressure surface fs and the suction surface bs of the stator blade. A slit 22 opening to the pressure surface fs of the stator blade is formed in a region corresponding to the stator blade trailing edge side end portion of the hollow portion 12*a* in the width direction of the stator blade 12, and is communicated with the stator blade trailing edge side end portion of the hollow portion 12*a*. Further, as illustrated in FIG. 1, the slit 22 is formed in a tip side region of the stator blade 12, and is arranged so as to extend along a height direction of the stator blade, i.e., in a direction substantially perpendicular to the flow direction of the wet steam flow s. On the pressure surface fs and the suction surface fs of the stator blade, water drops contained in the wet steam flow s attach to form a water film flow sw. The water film flow sw formed on the pressure surface fs and the suction surface bs of the stator blade is forced by the flow of the wet steam flow s to flow toward the trailing edge of the stator blade.

Figure 3:
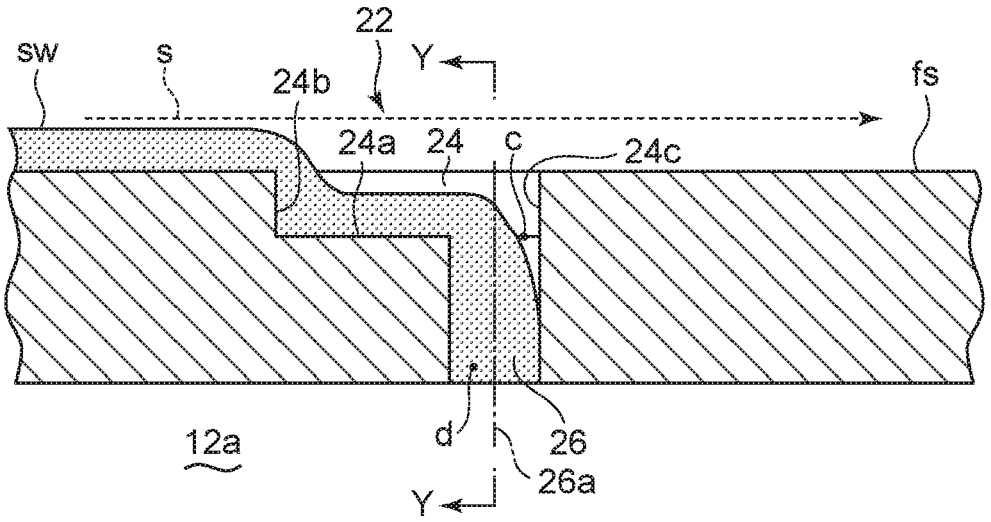
FIG. 3 is a transverse sectional view of a slit according to the first embodiment.
Figure 4:
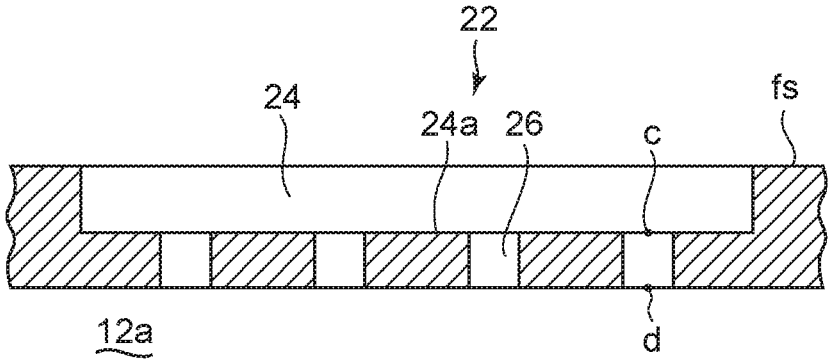
FIG. 4 is a longitudinal sectional view of a slit according to the first embodiment.

As shown in FIG. 3 and FIG. 4, the slit 22 includes a recess portion 24 opening to the pressure surface fs of the stator blade, and four through holes 26. The recess portion 24 includes a bottom surface 24*a* which is flat and which is substantially parallel to the pressure surface fs of the stator blade, and side surfaces 24*b* and 24*c* which are substantially perpendicular to the pressure surface fs of the stator blade. The recess portion 24 has an opening and a cross section, each of which has a rectangular shape, and a long side of the recess portion 24 faces a direction intersecting with the wet steam flow s.

A through hole 26 has a cylinder-like shape, of which axial line 26*a* is perpendicular to the pressure surface fs of the stator blade, and has an inlet opening c which opens to the stator blade trailing edge portion of the bottom surface 24*a* in the width direction of the stator blade, and an outlet opening d which opens to the stator blade trailing edge side end portion of the hollow portion 12*a*. That is, the through hole 26 is formed so that in a projection plane to which a cross section of the slit is projected in the width direction or the height direction of the stator blade, an area of the inlet opening c which opens to the bottom surface 24*a* of the recess portion occupies a part of a projection width of the recess portion 24.

Figure 5:
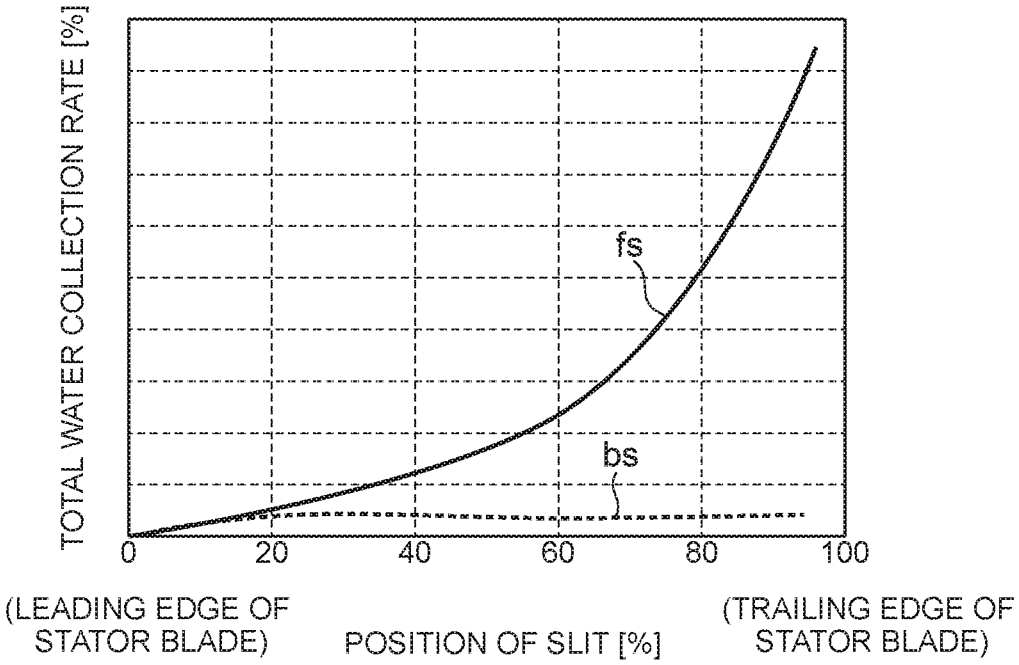
FIG. 5 is a chart showing total water collection rate on surfaces of the stator blade.

FIG. 5 is a chart showing a total water collection rate on the pressure surface fs and the suction surface bs of the stator blade. As shown in FIG. 5, the total water collection rate on the suction surface bs of the stator blade does not substantially change in the width direction of the stator blade; and in contrast, the total water collection rate on the pressure surface fs of the stator blade increases sharply as the position becomes closer to the trailing edge.

The chart of FIG. 5 shows that it is possible to increase the water removal amount as the inlet opening of the slit 22 is disposed closer to the trailing edge. Taking this into consideration, in this embodiment, the slit 22 is formed in a region which is, in the width direction of the stator blade 12, at the stator blade trailing edge side end portion of the hollow portion 12*a*.

In FIG. 3, the wet steam flow s flows from the stator blade leading edge side along the pressure surface fs of the stator blade, and the water film flow sw on the pressure surface fs of the stator blade also flow toward the trailing edge of the stator blade with the wet steam flow s. The water film flow sw reaches the slit 22 and flows into the recess portion 24, and then flows on the bottom surface 24*a* to flow into the through hole 26.

In this embodiment, the recess portion 24 has a large inlet opening relative to the through hole 26. Thus, the water film flow sw becomes more likely to flow from the inlet opening of the recess portion 24 to the recess portion 24, whereby it is possible to improve the water removal efficiency. Further, the water film flow sw flows into a relatively narrow inlet opening c of the through hole, and at this time, the through hole 26 is almost closed by the water film flow sw, whereby it is possible to suppress leakage of the wet steam flow s.

Although in the flow field of the wet stem flow s, the hub side region of the stator blade 12 has a higher pressure than the tip side region, since the slit 22 is formed in the tip side region of the stator blade 12, a circulation flow, where steam flow flowing from the through hole formed in the hub side region into the hollow portion 12*a* may reversely flows from the through hole formed in the tip side region to the steam flow field, may hardly be generated.

Further, since the slit 22 is formed in a region which is at the stator blade trailing edge side end portion of the hollow portion 12*a*, i.e., since the slit 22 is formed at a place where the total water collection rate increases, it is possible to increase the water removal amount.

Further, since the through hole 26 is formed at the stator blade trailing edge side end portion of the bottom surface 24*a* of the recess portion, the water film flow sw on the pressure surface fs of the stator blade flows into the recess portion 24 on the upstream side of the through hole 26 and then is stored on the bottom surface 24*a*. It is thereby possible to more effectively separate the water film flow sw from the wet steam flow s.

A method forming the slit 22 of this embodiment will now be described. The stator blade 12 has a high-temperature strength and corrosion resistance, and a Ni-based alloy, which is known as a hard-to-cut material, is used for the material. For this reason, precision processing of a Ni-based alloy including slit forming is conventionally performed by means of electric discharge machining, which is expensive.

The slit 22 is formed by carrying out electric discharge machining to carve the recess portion 24 firstly, and then carrying out cutting to form the through hole 26 by using a drill having a small diameter.

By employing expensive electric discharge machining only for forming the recess portion 24 and employing inexpensive cutting work for forming the through hole as described above, it is reduce the processing cost. It is difficult to form a small hole by means of electric discharge machining, and the diameter of a through hole is supposed to be at least 1 mm if electric discharge is employed. In contrast, by means of cutting work using a drill having a small diameter, it is possible to form a hole having a small diameter of about 0.5 mm. Accordingly, it is thereby possible to more efficiently suppress leakage of the steam as compared with the case of employing electric discharge machining.

Figure 6:
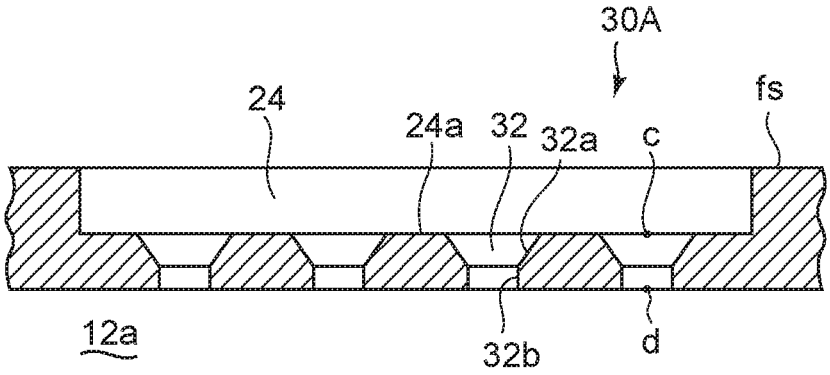
FIG. 6 is a longitudinal sectional view of a slit of a modified example of the first embodiment.

Modified examples of the first example having a modified shape of through hole 26 will now be described. The slit 30A illustrated in FIG. 6 is an example where the inlet side region 32*a* of the through hole 32 has a cross section of an inverted trapezoid like shape having a relative large width on the inlet side, and the outlet side 32*b* has a cylindrical shape. The water film flow sw thereby becomes more likely to flow into the through hole 32, and it is possible to improve the water removal efficiency.

Figure 7:
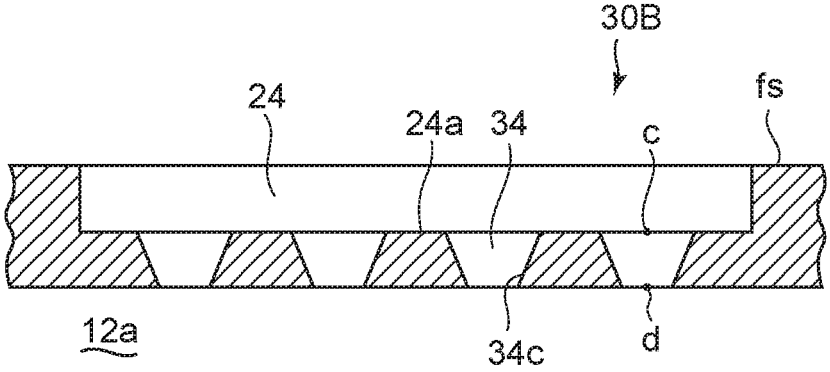
FIG. 7 is a longitudinal sectional view of a slit of another modified example of the first embodiment.

The slit 30B illustrated in FIG. 7 is an example where the through hole 34 has a cross section of an inverted trapezoid like shape having a relative large width on the inlet side, and has an inclined surface 34*c* which is inclined so as to form a lateral side of the trapezoid and which extends over the entire length of the through hole. In this example, since the through hole 34 has a further wider inlet opening, it is possible to further improve the water removal efficiency.

Second Embodiment

Figure 8:
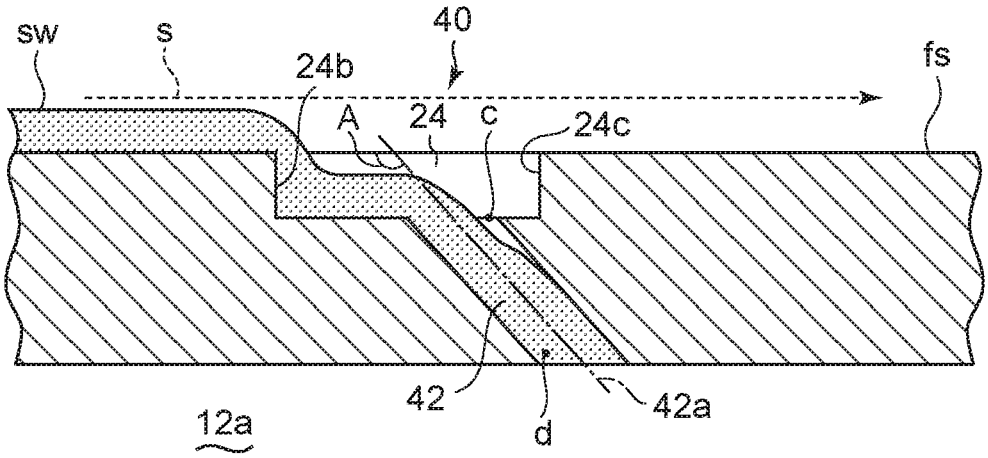
FIG. 8 is a cross sectional view illustrating a shape of a cross section of a slit according to a second embodiment of the present invention.

A second embodiment of the present invention now will be described with reference to FIG. 8. In terms of the shape of the slit 40 according to this embodiment, the recess portion 24 has the same shape as in the first embodiment, and, on the other hand, the through hole 42 has a different shape of a cross section from the through hole 26 in the first embodiment. That is, the through hole 42 has a cylindrical shape and has a constant diameter in the axial direction, and the axial line 42*a* inclined so that the inlet opening c is closer to the stator blade leading edge side than the outlet opening d. That is, the inclination angle A of the axial line 42*a* to the leading edge side reference plane of the pressure surface fs of the stator blade satisfies 90°<A<180°. The outlet opening of the through hole 42 is formed at the stator blade trailing edge side end portion of the recess portion 24, in the same manner as in the first embodiment. Further, except for the slit 40, the water removal device according to this embodiment basically has the same structure as in the first embodiment.

The slit 40 may be formed, in the same manner as in the first embodiment, by carrying out electric discharge machining to carve the recess portion 24 firstly, and then carrying out cutting to form the through hole 42 by using a drill having a small diameter. From a viewpoint of easiness of the processing and the strength of the stator blade 12, it is preferred that A satisfied 110°≤A.

According to this embodiment, since the axial direction of the through hole 42 faces the inflow direction of the water film flow sw, the water film flow sw becomes more likely to flow into the through hole 42, whereby it is possible to improve the water removal efficiency.

Third Embodiment

Figure 9:
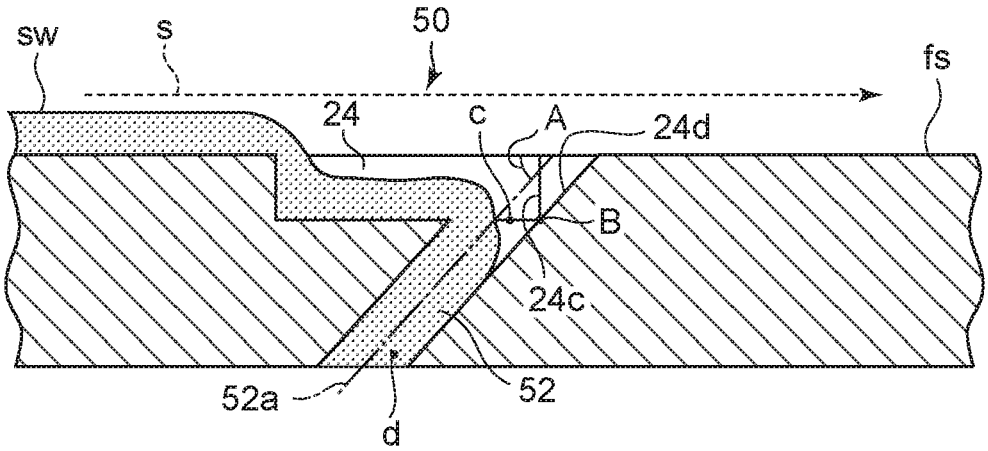
FIG. 9 is a cross sectional view illustrating a shape of a cross section of a slit according to a third embodiment of the present invention.

A third embodiment of the present invention will now be described with reference to FIG. 9. The recess portion 24 of the slit 50 according to this embodiment has the same shape as the recess portion 24 in the second embodiment, and the through hole 52 has a cylindrical shape and has a constant diameter in the axial direction, as is the case with the through hole 42 in the second embodiment. The through hole 52 is different from the through hole 26 in the second embodiment in that the through hole 52 is inclined so that the inclination angle A of the axial line 52*a* of the through hole 52 to the leading edge side reference plane of the stator blade fs of the pressure surface is an acute angle (0°<A<90°).

Further, a part of the stator blade trailing edge side-side surface of the recess portion 24 is formed by cutting work so as to form a curved surface 24*d* which is in the same direction as the axial line 52*a* and which is continuous to a wall surface of the through hole 52. The curved surface 24*d* is necessary when the through hole 52 is formed by means of cutting with a drill, and it is formed at the same time as the through hole 52.

The stator blade trailing edge side upper end B of the through hole 52 is at the same position, in the width direction of the stator blade, as the lower end of the stator blade trailing edge side-side surface of the recess portion 24. Except for the slit 50, the water removal device according to this embodiment basically has the same structure as in the first embodiment. From a viewpoint of easiness of the processing and the strength of the stator blade 12, it is preferred that A satisfied 20°≤A.

According to this embodiment, the outlet opening d of the through hole 42 may be positioned as closer to the stator blade leading edge side as possible, as the through hole 52 is inclined to the pressure surface fs of the stator blade. Accordingly, the slit 52 may be positioned at a stator blade trailing edge side while the outlet opening d is in communication with the stator blade trailing edge side end portion of the hollow portion 12*a*. Thus, the slit may be placed at a position where the total water collection rate is relatively large, whereby it is possible to further improve the water removal efficiency.

Fourth Embodiment

Figure 10:
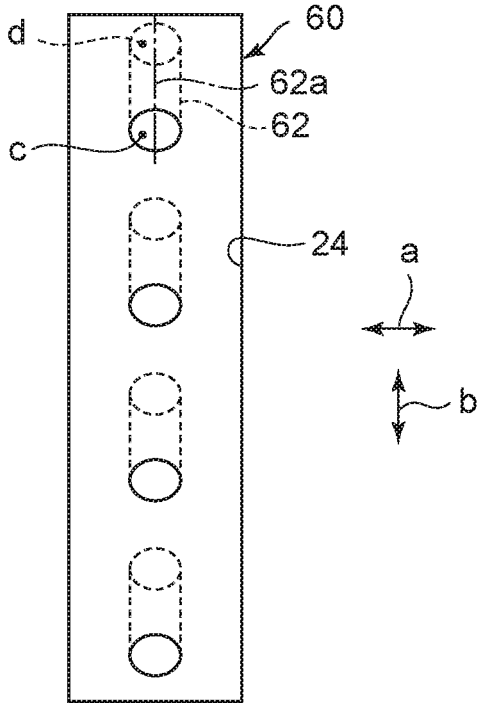
FIG. 10 is a front view illustrating a shape of a slit according to a fourth embodiment of the present invention.

A fourth embodiment of the present invention will now be described with reference to FIG. 10. In an actual flow field of the steam flow, the flow is not a one-dimensional flow, and it flows also along a radial direction of the surfaces of the stator blade, including the suction surface bs and the pressure surface fs of the stator blade. In such a region where the radial direction component of the flow is large, it is preferred that the through hole is three-dimensionally inclined toward the direction of the flow.

In this regard, in this embodiment, the slit is formed near the trailing edge re of the pressure surface bs of the stator blade where the flow field of the wet steam flow s in the radial direction from the hub side to the tip side is formed, and near the support ring 16.

The recess portion 24 of the slit 60 opens to the pressure surface fs of the stator blade, and the recess portion 24 has the same shape as the recess portion 24 in the first embodiment, and the longer sides are arranged in the height direction of the stator blade. The through hole 62 has a cylindrical shape and has a constant diameter in the direction of the axial line 62*a*. In this embodiment, the inlet opening c of the through hole 62 opening to the recess portion 24 is positioned closer to the hub side region than the outlet opening d opening to the hollow portion 12*a*. That is, the axial line 62*a* of the through hole 62 is inclined from the inlet opening c to the outlet opening d, from the hub side region toward the tip side region. Except for the slit 60, the water removal device according to this embodiment basically has the same structure as in the first embodiment.

The water film flow sw formed on the pressure surface fs of the stator blade flows in the height direction of the stator blade from the hub side to the tip side, with the wet steam flow s flowing from the hub side region to the tip side region.

According to this embodiment, since the through hole 62 is formed so as to be inclined in the same direction as the flowing direction of the water film flow sw flowing to the tip side, the water film flow is more likely to flow into the through hole 62, whereby it is possible to improve the water removal efficiency.

Fifth Embodiment

Figure 11:
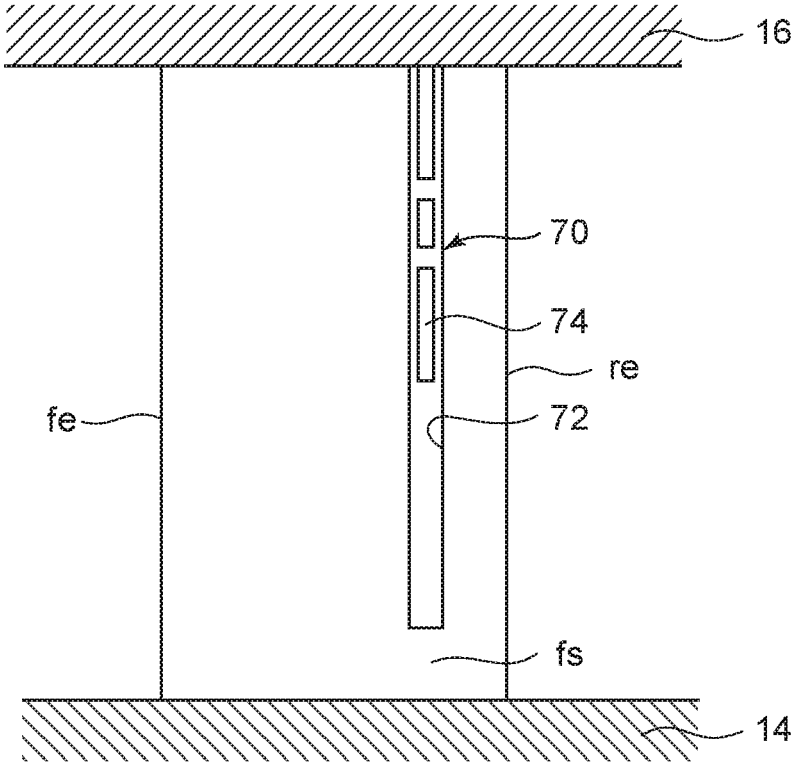
FIG. 11 is a front view illustrating a shape of a slit according to a fifth embodiment of the present invention.

A fifth embodiment of the present invention will now be described with reference to FIG. 11. The slit 70 according to this embodiment opens to the pressure surface fs of the stator blade, and is formed at a position where the through hole 74 can be communicated with the stator blade trailing edge side end portion of the hollow portion 12*a*, as in the first embodiment. The slit 70 is formed in the height direction of the stator blade. In the slit 70, the recess portion 72, excluding a part in the hub side region, extends over the entire region in the height direction of the stator blade, and three through holes 74 are formed only in the recess portion 72 in the tip side region. Each of the three through holes 74 has a slit-like shape and is formed so that the axial line of the through hole 74 is perpendicular to the pressure surface fs of the stator blade. Except for the arrangement and the shape of the slit 70, the water removal device according to this embodiment basically has the same structure as in the first embodiment.

The recess portion 72 may have a width within a range such that the blade surface is not deviated from the designed blade profile of the stator blade 12. For example, the width of the recess portion 72 may be about twice (twice±10%) as large as the through hole 74.

According to this embodiment, since the recess portion 72 is formed over almost entire region, in the height direction of the stator blade, of the pressure surface fs of the stator blade, it is possible to collect the water film flow sw in the recess portion over almost entire region of the leading edge fe of the stator blade. By introducing the water collected in the recess portion to the through hole, it is possible to improve the water removal efficiency.

When the opening of the through hole 74 is formed into a slit like shape, it may be necessary to employ electric discharge machining, and the processing cost may increase. However, since the through hole has a slit-like shape having a relatively large opening area, it is possible to increase the flow rate of the water film flow sw flowing out of the through hole 74. It is thereby possible to improve the water removal efficiency.

As shown in FIG. 5, in a case where the slit which opens to the pressure surface fs of the stator blade is formed, by forming the slit as closer to the trailing edge re side of the stator blade as possible, it is possible to improve the water removal efficiency. Further, even in a case where the slit which opens to the suction surface bs of the stator blade is formed, it is possible to increase the water removal amount, by forming the slit as closer to the trailing edge re side of the stator blade.

Although in the above-described embodiments, the slit opens to the pressure surface of the stator blade, in some embodiments, the slit may open to the suction surface of the stator blade. A water removal device according to the present invention may be constituted by combination of two or more of the above-described embodiments, as needed.

EXAMPLES

Figure 12:
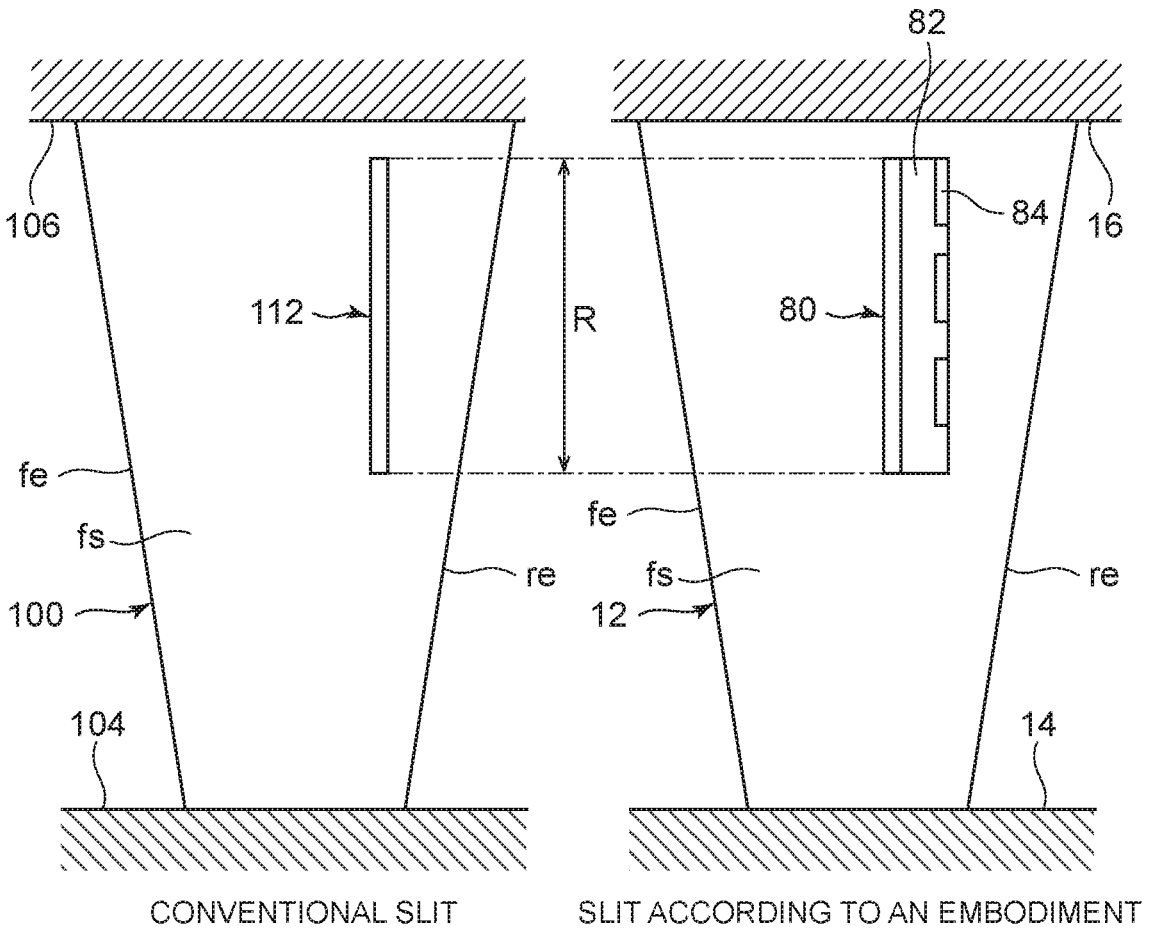
FIG. 12 is a front view of a slit according to an embodiment and a front view of a conventional slit, which are used for an effect evaluation experiment.

Now, effect evaluation experiments and the results, which were performed to evaluate the effect provided by the water removal device according to an embodiment of the present invention, will be described with reference to FIG. 12 to FIG. 15. First, with reference to FIG. 12, a conventional slit and a slit according to an embodiment of the present invention used in the experiments are described. In FIG. 12, each of the conventional slit 112 and the slit 80 according to the embodiment is arranged along the height direction of the stator blade 100 or 12, and is formed in the same tip side region R. Each of the support ring 106 and the support ring 16 has a hollow portion (not shown) inside the support ring, and the hollow portion is in communication with the slit 80 or 112 via a hollow portion formed in the stator blade 100 or 12. Each of the slit 112 and the slit 80 opens to the pressure surface fs of the stator blade and is formed in a region corresponding to the stator blade trailing edge side end portion of the hollow portion formed inside the stator blade 100 or the stator blade 12, in the width direction of the stator blade.

Figure 21:
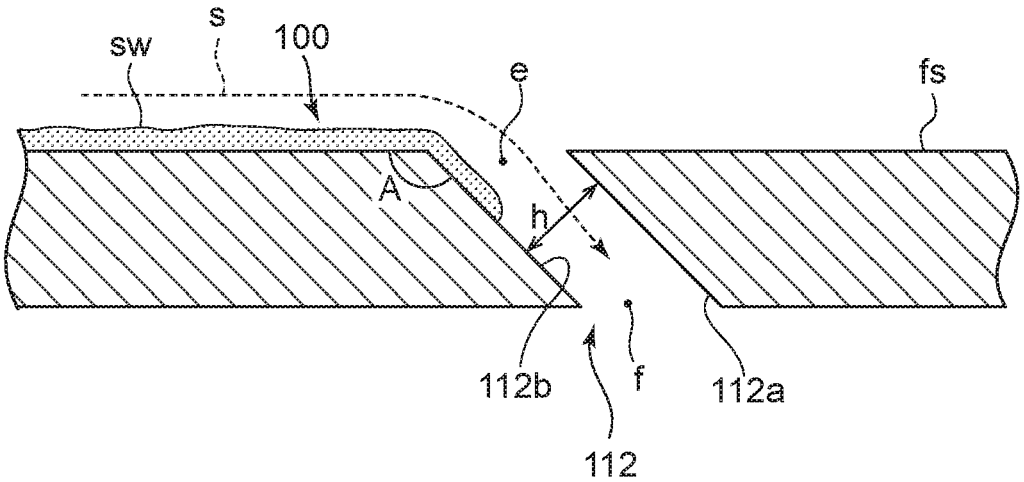
FIG. 21 is an enlarged cross sectional view of portion Y in FIG. 20.

The slit 112 has the same structure as the slit 112 illustrated in FIG. 21, and the inclination angle of the slit 112 to the leading edge side reference plane of the pressure surface fs of the stator blade is 135°.

Figure 13:
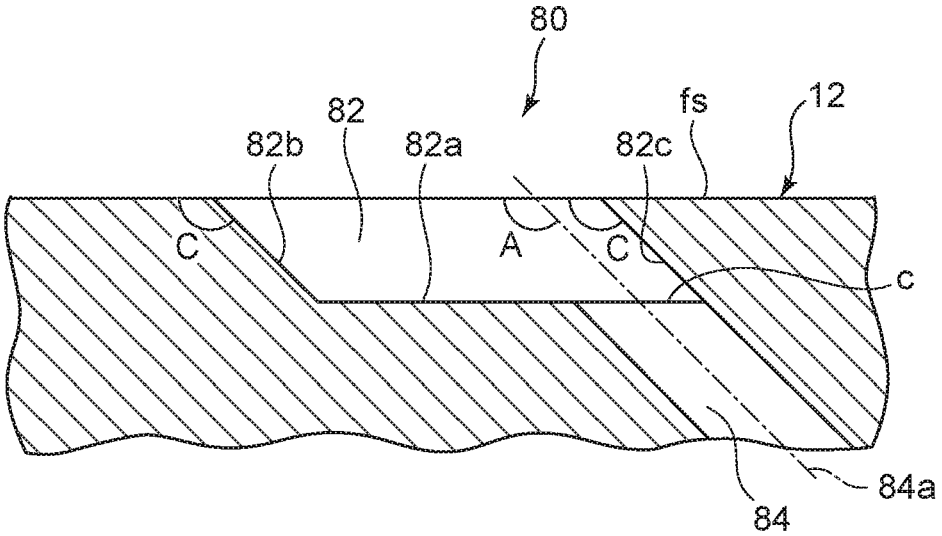
FIG. 13 is a transverse sectional view of the slit shown in FIG. 12.

FIG. 13 is a transverse sectional view of the slit 80. The slit 80 is a modification of the slit 40 illustrated in FIG. 8, according to the second embodiment. That is, the recess portion 82 has a bottom surface 82*a* which is flat and which is parallel to the pressure surface fs of the stator blade fs, and side surfaces 82*b* and 82*c* each of which is inclined to the pressure surface fs of the stator blade, and the inclination angle C of each of the side surfaces is 135°.

As shown in FIG. 12, the through hole 84 has an inlet opening c having a rectangular shape. The through hole 84 is inclined to the leading edge side reference plane of the pressure surface fs of the stator blade, and the inclination angle A is 135°. The side surface 82*c* of the recess portion 82 and the through hole 84 together form a continuous flat surface.

The slit 80 is obtained by forming the recess portion 82 and the through hole 84 by means of electric discharge machining. In the experiments, as the working fluid mf, a two-phase fluid containing air having water added, simulating an actual wet steam flow s, was used. The particle size of the water was made substantially the same as the particle size of the water contained in the wet steam flow s.

Figure 14:
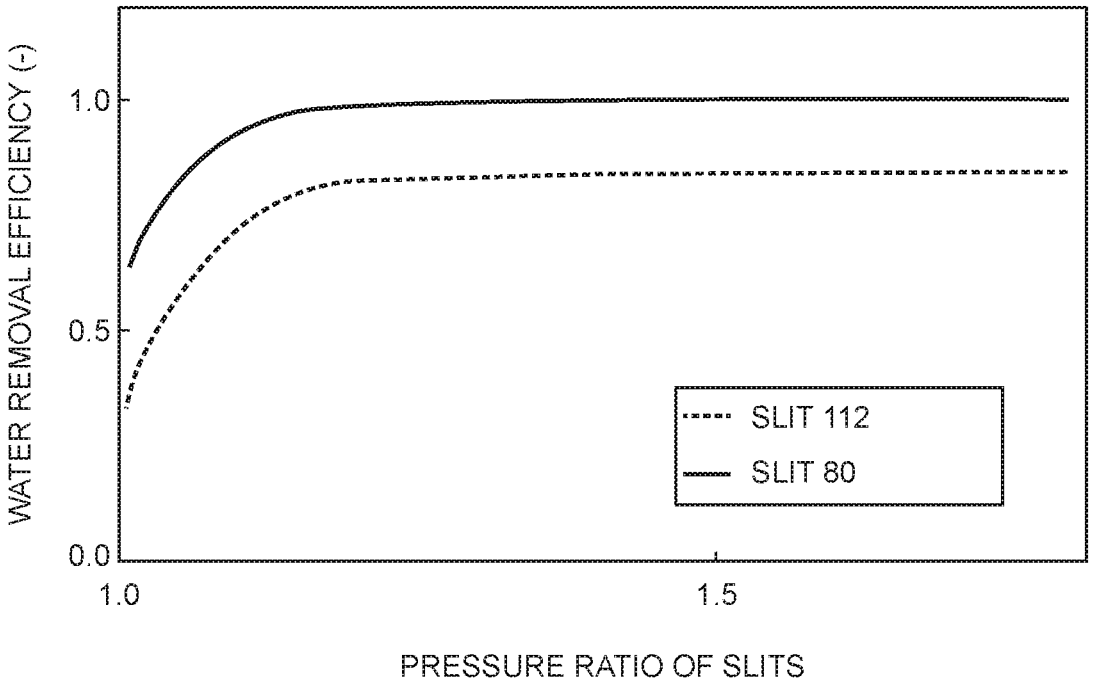
FIG. 14 is a chart showing a test result of the effect evaluation experiment.
Figure 15:
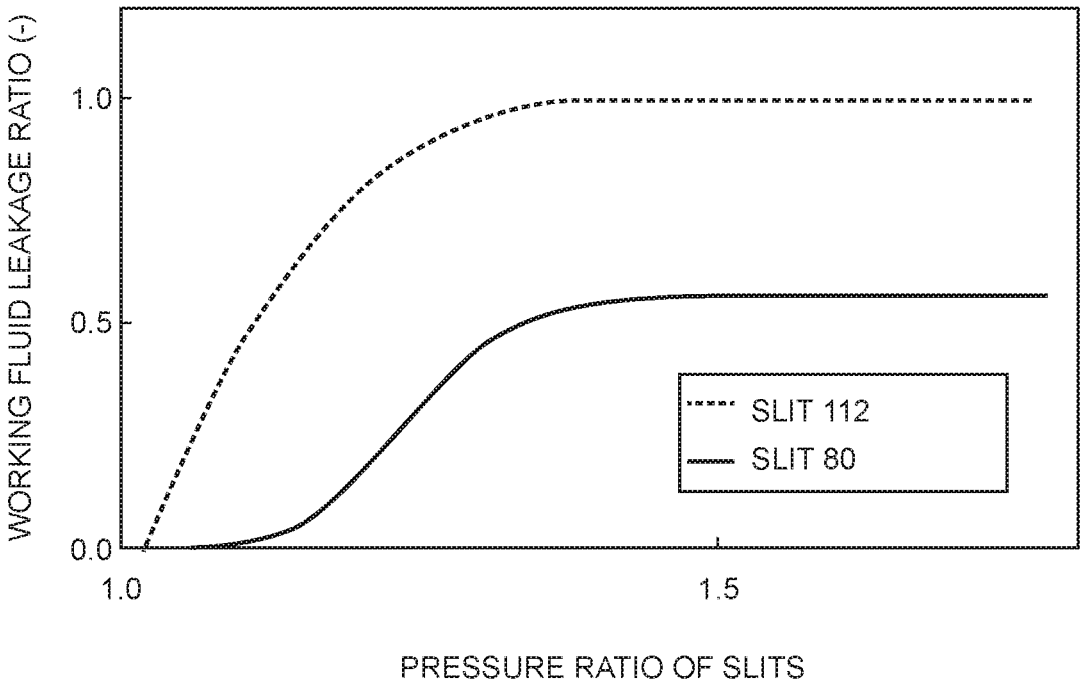
FIG. 15 is a chart showing another test result of the effect evaluation experiment.
Figure 16:
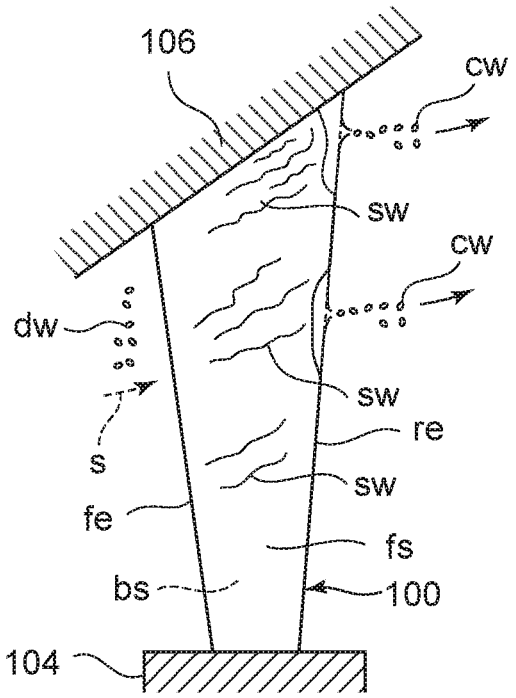
FIG. 16 is an explanatory diagram illustrating a flow field of a wet steam flow in a steam turbine.

FIG. 14 is a chart showing the water removal efficiency of both of the slits, and FIG. 15 is a chart showing the leakage ratio which represents the ratio of the working fluid mg leaked to the hollow portion 12*a* of the stator blade 12. Each of the horizontal axes (pressure ratio of the slits) of the charts of FIG. 14 and FIG. 15 represents the ratio (pressure on the pressure surface fs side of the stator blade)/(pressure in the hollow portion 12*a*).

FIG. 14 and FIG. 15 show that, with respect to both the slit 112 and the slit 12, the water removal efficiency and the working fluid leakage ratio increase as the pressure ratio of the slits increases. FIG. 14 shows that the water removal efficiency of the slit 80 is larger than that of the slit 112 by approximately 10 to 20%, and FIG. 15 shows that the working fluid leakage ratio of the slit 80 is smaller than that of the slit 112 by at least 50%.

The reason for this is, as described above, that since the recess portion 82 has a relatively wide inlet opening than the through hole 84, the water film flow sw is more likely to flow into the recess portion 82, whereby it is possible to improve the water removal efficiency, and since the water film flow sw flows into the relatively narrow inlet opening c of the through hole 84, the through hole 84 is almost closed by the water film flow sw, whereby it is possible to suppress leakage of the wet steam flow s.

Since in the slit 80, the side surface 82*c* of the recess portion 82 and a side surface of the through hole 84 together form a flat surface, and the side surface 82*b* of the recess portion 82 has the same inclination angle as the side surface 82*c*, the slit 80 may be formed more easily.

INDUSTRIAL APPLICABILITY

According to the present invention, it is possible to improve the removal efficiency of the water film flow formed on a surface of a stator blade and to suppress erosion of a rotor blade and leakage loss of the steam flow, by simple processing of the stator blade, whereby it is possible to suppress reduction in the turbine efficiency.

REFERENCE SIGNS LIST

10 Water removal device
12, 100 Stator blade

12*a*, 100*a* Hollow portion (Water removal flow passage)
14, 104 Diaphragm
16, 106 Support ring
16*a*, 106*a* Hollow portion
18, 20, 106*b*, 106*c* Hole
22, 30A, 30B, 40, 50, 60, 70, 80, 112, 114 Slit
24, 72, 82 Recess portion
24*a*, 82*a* Bottom surface
24*b*, 24*c*, 82*b*, 82*c* Side surface
24*d* Curved surface
112*a* Stator blade trailing edge side wall surface
112*b* Stator blade leading edge side wall surface
e Inlet opening
f Outlet opening
26, 32, 34, 42, 52, 62, 74, 84 Through hole
32*a* Inlet side region
32*b* Outlet side region
34*c* Inclined surface
c Inlet opening
d Outlet opening
h Slit width
42*a*, 52*a*, 62*a*, 84*a* Axial line
102 Rotor blade
108 Rotor shaft
110 Disk rotor
116 Slit groove
c Inlet opening
d Outlet opening
A Inclined angle
U Circumferential velocity
Vs, Vcw Absolute velocity
Ws, Wcw Relative velocity
bs Suction surface of stator blade
cw Coarse water drop
dw Small water drop
fe Leading edge of stator blade
fs Pressure surface of stator blade
mf Working fluid
re Trailing edge of stator blade
s Wet steam flow
sw Water film flow

The invention claimed is:

1. A water removal device for a steam turbine for removing water on a surface of a stator blade, the water removal device comprising:

a water removal flow passage defined inside the stator blade; and a slit extending in a direction intersecting with a steam flow direction and opening to the surface of the stator blade, wherein the slit includes a recess portion having a difference in level from the surface of the stator blade and having a bottom surface which is flat and parallel to the surface of the stator blade, and at least one through hole which opens to the bottom surface of the recess portion and to the water removal flow passage, wherein, in a projection plane to which a cross section of the slit is projected in a height direction of the stator blade, an area of an inlet opening of the at least one through hole which opens to the bottom surface of the recess portion occupies a part of a projection width of the bottom surface of the recess portion, wherein the at least one through hole has a symmetrical shape with respect to an axis of the at least one through hole and a cross section of the at least one through hole has an inverted trapezoid shape along the axis of the at least one through hole from the water removal flow passage to the recess portion such that the inverted trapezoid shape extends from the inlet opening of the at least one through hole to an outlet opening of the at least one through hole, and the outlet opening of the at least one through hole opens to the water removal flow passage, wherein the inverted trapezoid shape is defined by: (i) a first planar side at the inlet opening of the at least one through hole; (ii) a first inclined side; (iii) a second planar side at the outlet opening of the at least one through hole; and (iv) a second inclined side, and wherein the first planar side of the inverted trapezoid shape is longer than the second planar side of the inverted trapezoid shape.

2. The water removal device according to claim 1, wherein the at least one through hole is defined in a tip side region of the surface of the stator blade.

3. The water removal device according to claim 1, wherein the slit is defined on the surface of the stator blade, and wherein the inlet opening of the at least one through hole opens to a surface side corresponding to a trailing edge side end portion of the water removal flow passage, and the outlet opening of the at least one through hole is in communication with a trailing edge side end portion of the slit.

4. The water removal device according to claim 1, wherein the inlet opening of the at least one through hole is defined in a stator blade trailing edge side end portion of the bottom surface of the recess portion.

5. The water removal device according to claim 1, wherein, in the projection plane to which the cross section of the slit is projected in the height direction of the stator blade, the area of the inlet opening of the at least one through hole occupies only the part of the projection width of the bottom surface of the recess portion, and wherein, in a projection plane to which a cross section of the slit is projected in a width direction of the stator blade, an area of the inlet opening of the at least one through hole occupies only a part of a projection width of the bottom surface of the recess portion.

6. A method for forming a slit as defined in claim 1, comprising:

forming, on the surface of the stator blade, a recess portion having a difference in level from the surface of the stator blade and having a bottom surface which is flat and parallel to the surface of the stator blade by electric discharge machining; and forming at least one through hole by cutting work so that: the at least one through hole opens to the bottom surface of the recess portion and to the water removal flow passage; and, in a projection plane to which a cross section of the slit is projected in the height direction of the stator blade, an area of the inlet opening of the at least one through hole which opens to the bottom surface of the recess portion occupies a part of a projection width of the bottom surface of the recess portion, wherein the at least one through hole is formed by drilling so as to open to the bottom surface of the recess portion such that the cross section of the at least one through hole has the inverted trapezoid shape along the axis of the at least one through hole from the water removal flow passage to the recess portion such that the inverted trapezoid shape extends from the inlet opening of the at least one through hole to the outlet opening of the at least one through hole.

7. The water removal device according to claim 1, wherein the at least one through hole extends from the inlet opening to the outlet opening in a direction opposite to the steam flow direction.

* * * * *